US009296169B1

(12) United States Patent
Rodriguez

(10) Patent No.: US 9,296,169 B1
(45) Date of Patent: Mar. 29, 2016

(54) ROLLER PRESS

(71) Applicant: Adolfo Rodriguez, Hialeah, FL (US)

(72) Inventor: Adolfo Rodriguez, Hialeah, FL (US)

( * ) Notice: Subject to any disclaimer, the term of this patent is extended or adjusted under 35 U.S.C. 154(b) by 0 days.

(21) Appl. No.: 14/542,896

(22) Filed: Nov. 17, 2014

(51) Int. Cl.
*B30B 3/04* (2006.01)
*B30B 3/00* (2006.01)
*B30B 9/20* (2006.01)

(52) U.S. Cl.
CPC . *B30B 3/005* (2013.01); *B30B 3/04* (2013.01); *B30B 9/20* (2013.01)

(58) Field of Classification Search
CPC ..... B30B 3/005; B30B 3/04; B30B 9/20; B30B 9/202; A47J 19/02; A23N 1/00; A23N 1/003; C13B 10/02; C13B 10/06; C13B 15/00; A23L 2/00
USPC ..... 100/121, 155 R, 161, 162 R, 176; 241/36, 159; 127/2, 43; 99/501; 72/238, 239
See application file for complete search history.

(56) References Cited

U.S. PATENT DOCUMENTS 3,111,742 A * 11/1963 Lakin ..... B29D 99/0035 100/155 R
3,482,607 A * 12/1969 Villani ..... D03D 49/06 139/304
4,104,760 A * 8/1978 Rosseau ..... A46B 13/02 15/179
5,170,699 A * 12/1992 Senalada ..... A23N 1/003 99/504
5,320,035 A * 6/1994 Sanchez ..... C13B 10/06 100/121

* cited by examiner

*Primary Examiner* — Jimmy T Nguyen
(74) *Attorney, Agent, or Firm* — Christopher J. VanDam, PA; Chris Vandam

(57) ABSTRACT

A roller press suited for pressing matter between rollers. Parallel shafts each have a roller fitted over the shaft. At an end of each shaft is a slot with an underlying pocket. Across an inside end of the roller is a pin. When a roller is installed over a shaft, the pin engages into the slot and then into the pocket. When the shaft is rotated under torque the pin seats inside the pocket and cannot be axially removed from the shaft. When the torque is removed the pin and slot can re-align allowing removal of the roller from the shaft for easy maintenance and cleaning.

6 Claims, 3 Drawing Sheets

ROLLER PRESS

BACKGROUND OF THE INVENTION

1. Field of the Invention

The present invention relates to food processing, and more particularly, to a roller press that can, for example, compress sugarcane to extract the natural juice. Other applications will become apparent throughout the drawings and description.

2. Description of the Related Art

Several designs for roller presses have been designed in the past. None of them, however, includes a way to easily remove the rollers to clean the device for the most sanitary treatment of the machine and its constituent parts.

Other roller presses have been known for many years. Typical designs have two or more stiff rollers spaced apart so that there is a constant gap between the rollers. The material to be pressed is passed between the rollers. The gap is smaller than the material being passed through the press resulting in great pressure applied during the pressing procedure.

As the material to be pressed is squeezed between the rollers the juices, oils, sap and other components are freed from the base material. The removed matter, often a gel or liquid, drips down by force of gravity into a collection vessel.

For example, a traditional manual cane press may have three rollers, each closely spaced. At least one of the rollers is powered by a hand crank, motor or animal motion. A stalk of sugarcane (or other plant material) is fed between the rollers and is summarily crushed and squeezed to separate the solids from the liquids.

Other types of presses have been used and are not suitable to the disclosed technology. For example, centrifugal spin presses and simple plate pressure presses are used in other applications and for specific plant matter.

Applicant believes that the closest reference corresponds to U.S. Pat. No. 5,320,035 issued to Sanchez. However, it differs from the present invention because the Sanchez patent fails to solve the problem of how to effectively remove the rollers for maintenance and cleaning procedures.

Sanchez notes in dictum that the rollers can be attached to the roller shafts with a spline or key on the roller that mates with a corresponding slot on the shaft. Admittedly, this method has had some success. However, it is far from fully satisfactory.

Roller presses can be used to extract viscous and sticky liquids. For example, raw sugar extract poses specific hazards and complications when applied to precise machinery. When fresh or dried it can gum up the mechanisms of the machine. The spline and key type roller attachment means is particularly susceptible to the deleterious effects of repeated and constant contact with plant juices.

In short, the type of press taught by Sanchez will require frequent, often daily, cleaning. The spline and keyway combination can become gummed up and essentially bonded thereby making removal of the rollers from the machine difficult. Often this results in the need for use of tools to remove the roller. Far too often tools are misplaced or broken making the job of removal of the rollers exceedingly difficult for many users of a roller press.

It is human nature to avoid issues that are difficult. The harder it is to remove the rollers from a roller press, the less frequently they are removed. The less frequently rollers are removed the greater the likelihood of foodborne contamination, insect infestation and damage to the machine from corrosion and general neglect.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a roller press machine that allows easy and tool-less removal of the rollers for maintenance and cleaning.

It is another object of this invention to provide a food processor machine that is more sanitary to promote the health and welfare of operators of the machine and the end consumer of the products produced with the press.

It is still another object of the present invention to provide a device to effectively separate liquids and juices from a variety of natural plant materials.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
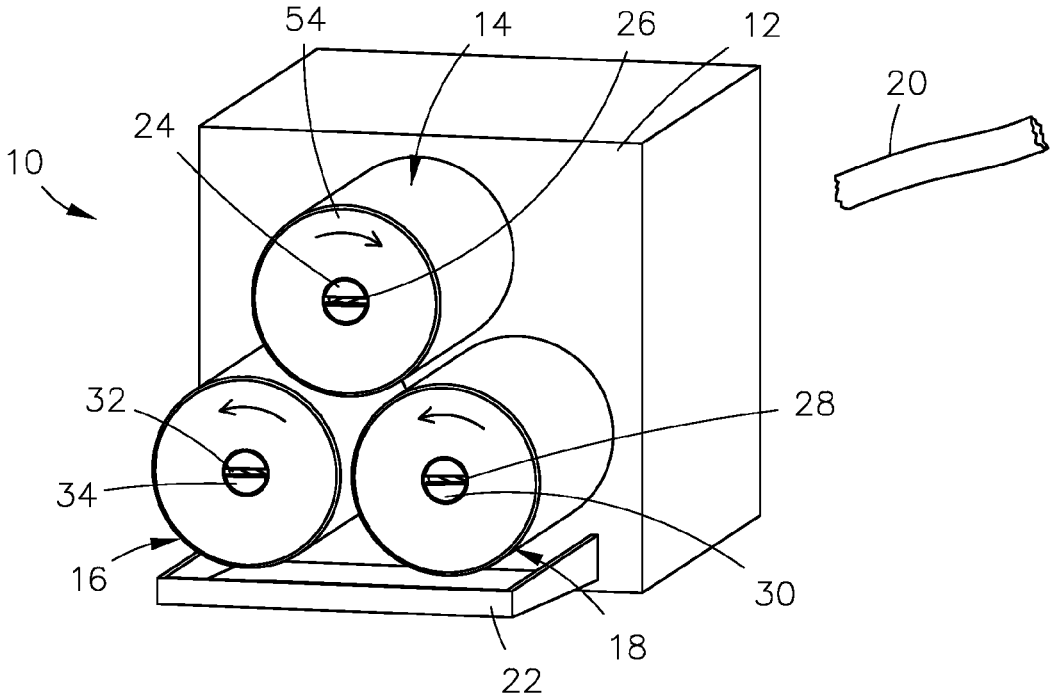
FIG. 1 represents a perspective view of an example of a roller press.

The subject device and method of use is sometimes referred to as the device, the invention, the press, roller press, machine or other similar terms. These terms may be used interchangeably as context requires and from use the intent becomes apparent. The masculine can sometimes refer to the feminine and neuter and vice versa. The plural may include the singular and singular the plural as appropriate from a fair and reasonable interpretation in the situation.

Referring now to the drawings, where the present invention is generally referred to with numeral 10, it can be observed that it basically includes a case 12, a roller 14, a roller 16, a roller 18, a vessel 22, a shaft 24, a pin 26, a pin 28, a shaft 30, a pin 32, a shaft 34, a bore 36, an aperture 38, an aperture 40, a surface 42, a seal 44, a slot 46, a pocket 48, a seat 50, a bearing 52, a face 54, a roller 56, a face 58, posts 60, an aperture 62 and a bore 64. Sugarcane 20 is provided for context and is not a claimed component of the device.

Generally, a drive mechanism is provided inside the case 12 to power one or more of the shafts 24, 30 and 34. The drive mechanism can be powered by an electric motor, fossil fuel engine, by a hand operated crank or other available sources of motive energy. There may be gears included between the power source and shafts 24, 30 and 34 to create a mechanical advantage to ensure sufficient energy is available to draw material through the rollers 14, 16 and 18 and appropriately squeeze the material for extraction.

Figure 3:
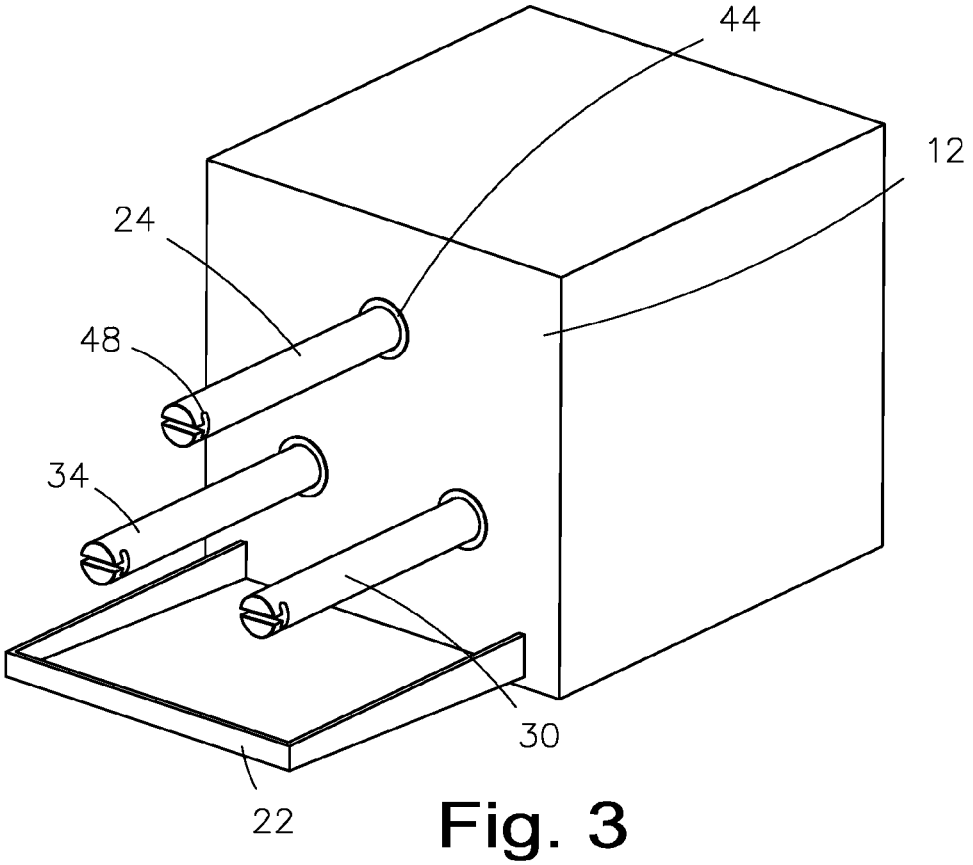
FIG. 3 illustrates a perspective view of an iteration of a roller press with the rollers removed.

In normal operations the shafts 24, 30 and 34 are integral with the rest of the machine as seen in FIG. 3. The roller 14 is fit axially over shaft 24. The roller 18 is fit axially over shaft 30. The roller 16 is fit axially over shaft 34. During normal use of the machine the shafts 24, 30 and 34 are not removable from the machine but may be removed during major maintenance. The rollers, 14, 16 and 18 are attached to the machine and are easily removed for daily maintenance and cleaning.

The spacing between the rollers 14, 16 and 18 is important to the performance of the machine as a whole. The spacing should be sufficient to allow passage of the solid material passed between the rollers and simultaneously exert sufficient pressure to separate any liquids from the solids that carry those liquids.

For a given machine, the locations of the shafts 24, 30 and 34 are generally fixed. The diameters of the rollers 14, 16 and 18 can be selected to adjust the spacing between the rollers 14, 16 and 18. For example, if the diameters of selected rollers are smaller, then the gaps between the rollers increase. The size of the materials introduced between the rollers, the relative moisture content, the viscosity of the liquid to be extracted and hardness of the solid material, among other things, may all be considered when selecting the appropriate roller diameter.

The diameter of the rollers 14, 16 and 18 need not all be identical. In some applications it may be beneficial to employ rollers of differing sizes. For example, if the lower rollers 16 and 18 are smaller than the upper roller 14 then the material passed through the machine may be forced to bend more because it is pressed further from the top roller 14. This bending action can be beneficial to the most efficient extraction of liquids from the solid parts.

Figure 2:
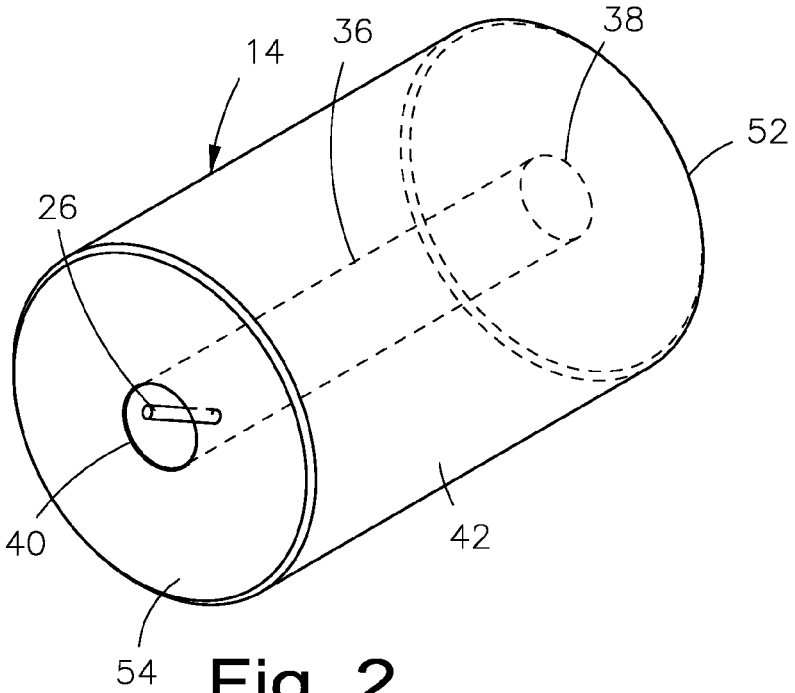
FIG. 2 shows a perspective view of a version of a roller that may be part of a roller press.

An example of a roller 14 configuration is seen in FIG. 2. Each of the several rollers 14, 16 and 18 are similar in dimension and materials. Although it may be possible for the device to use two, four or more rollers, the three roller configuration as seen in FIG. 1 is particularly effective at extracting cane juice from sugarcane in an energy efficient and sugarcane efficient manner.

To extract natural juice from the fibers of a stalk of sugarcane 20 the machine is activated so that the rollers 14, 16 and 18 rotate along with their respective shafts 24, 34 and 30 in the directions indicated by the arced arrows in FIG. 1. The three rollers act in concert to both draw the sugarcane 20 through the device and to also press the sugarcane 20 sufficiently to squeeze the juice contained in the fibers of the sugarcane 20 and separate it from the fibrous solids.

It should be appreciated that materials other than sugarcane could be juiced by the device. There are other plant juices, oils and extracts that can be separated from their natural host flora by means of high pressure pressing. In some uses other materials could also be effectively pressed including pasta, fish or other products.

Figure 4:
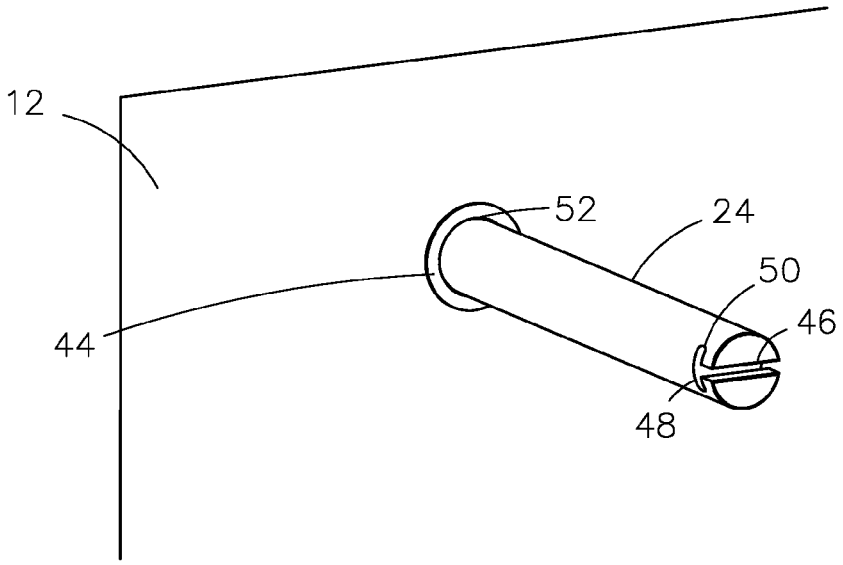
FIG. 4 is a representation of a partial perspective view demonstrating a shaft without roller in more detail.

FIG. 4 shows a close up view of an example of a shaft 24. Each of the several shafts on a device could be similar in design and function to that shown in FIG. 4. At the point on the shaft 24 where the shaft 24 enters the case 12 a seal 44 is provided to prevent any unwanted juice or plant material from entering the case 12.

The shaft 24 also, in an important version of the device, includes a bearing 52 about which the shaft 24 rotates axially. The force imparted onto the shaft 24 during the juicing procedure can be significant so the bearing 52 should be resilient. The seal 44 can protect the mechanism of the bearings 52. The bearing 52 could be manifest as a roller bearing, ball bearing, ring bearing or other bearing available in the mechanical arts sufficiently sturdy to support the rollers during the pressing and extraction procedure.

In a version of the device, the seal 44 can act both as a seal and as a bearing. For example, a seal 44 made of acetal, HDPE or other similar material could be sufficient to act as a bearing and a seal without another separate bearing element. A seal and a bearing could, however, be effectively used in concert to effectively seal and provide a bearing surface for a shaft.

A vessel 22 is optionally positioned below the rollers to catch any extracted juices (or other effluence) that drop by gravity. The vessel 22 could take the form a tray similar to that seen clearly in FIG. 3. Alternatively, a funnel or other catchment means could be effective at capturing released fluids as they are pressed by the machine in normal operation.

Figure 5:
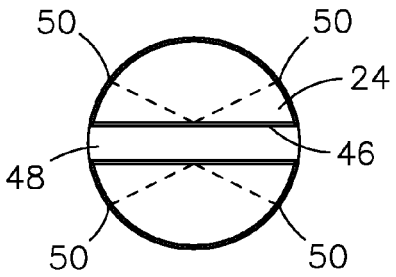
FIG. 5 is an elevation view of an end of a shaft without a roller installed.
Figure 6:
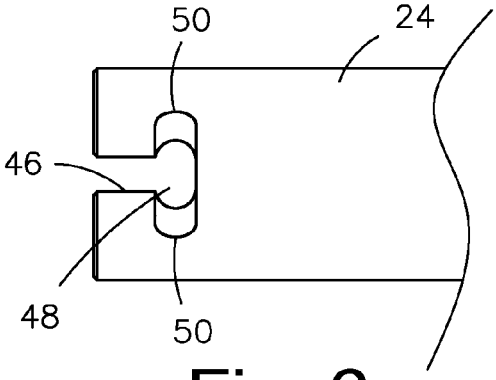
FIG. 6 is a side elevation view of a side of shaft similar to that shown in FIG. 5.

An important aspect of the roller press can be seen when reading the figures in combination. FIGS. 4, 5 and 6 show a similar configuration of an end of a shaft 24 that includes a slot 46, a pocket 48 and a seat 50. The slot 46 separates the tip of the shaft 24 slightly wider than the diameter of the pin 26. The pin 26 should readily pass through the slot 46 when installing or removing a roller 14 from the shaft 24.

As a roller 14 is inserted over the shaft 24 the pin 26 inside the end of the roller 14 aligns and fits into the pocket 48. The roller 14 and integral pin 26 are rotated and the pin 26 aligns askew from the slot 46 and is held against the seat 50. Energy from the shaft 24 is transferred to the seat 50 into the pin 26 and ultimately causes the roller 14 to rotate.

Looking at FIG. 5, the seats 50 are positioned to both sides of the slot 46 to allow the pin to rotate in either a clockwise or counter clockwise direction and to firmly lock the pin 26 and therefore the roller 14 relative to the shaft 24. When the pin 26 is askew from the slot 46, the roller 14 is essentially locked onto the shaft 24 because the pin 26 is not aligned over the slot 46. The roller 14 can then be easily removed by aligning the pin 26 with the slot 46 when the machine is not in operation and no force is imparted on to the shaft 24. With no force on the shaft the roller 14 can be gripped by the operator and rotated slightly so that the pin 26 is aligned with the slot 46 and then the roller 14 can be pulled off of the shaft 24 and be separated from the machine.

The seats 50 as shown in broken lines in FIG. 5, are adapted so that when the pin 26 is rotated inside the pocket 48, both ends of the pin 26 inside the roller 14 seat firmly to opposite sides of the seat 50. In this fashion, rotational force is applied to both ends of the pin 26 assuring even application of force from the shaft 24 to the roller 14.

The seat 50 is positioned away from the end of the shaft 24 approximately the same distance as the pin 26 is from face 54. The diameter of the pin 26 is, in an ideal embodiment, slightly smaller than the width of the slot 46 so that when aligned with the slot 46, the pin 26, and therefore the roller 14, can be installed or removed.

In an important version of the device, seat 50 has a radius similar to the radius of pin 26, such that pin 26 nests firmly into seat 50 at both ends of the pin 26. This aids in preventing any slop in the fit between the pin 26 and seat 50 while torque is applied to the pin 26 through the shaft 24 assures smooth operation of the device.

Figure 7:
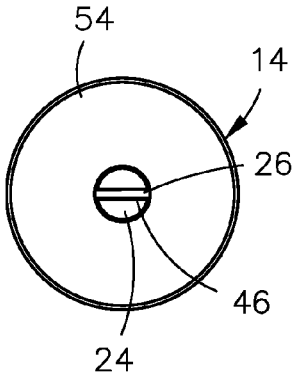
FIG. 7 is an elevation view of an end of a roller part way through installation on a shaft.
Figure 8:
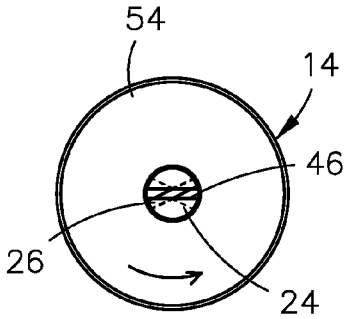
FIG. 8 is an elevation view of an end of a roller partly installed onto to a shaft.

FIGS. 7 and 8 show a similar embodiment to that in FIGS. 4, 5 and 6 from an elevation view towards the face 54 at the end of the roller 14. In FIG. 7, the pin 26 is aligned with the slot 46 as it would be as the roller 14 is slid onto the shaft 24 during installation of the roller 14. The pin 26 can be fully inserted through the slot 46 so that when rotated, as in FIG. 8, the pin 26 rests firmly against the seat 50. FIG. 8 is an example of how the device might appear while in use pressing cane.

Figure 9:
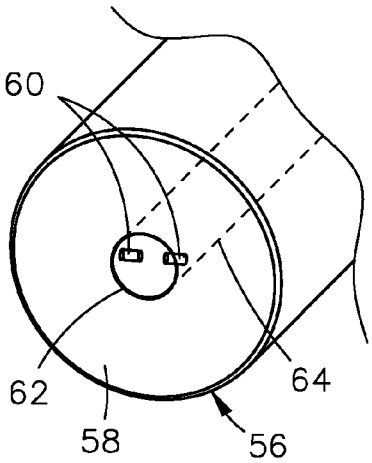
FIG. 9 is a partial perspective end view of a version of a roller.

Now referring to FIG. 9 where an alternate version of a roller 56 is shown to have posts 60 inside the aperture 62 nearest the outside face 58 of the roller 56. Posts 60 are an alternate structure to the pin 26 shown in inter alia FIG. 2. The posts 60 engage into a slot 46 and a pocket 48 and rest against a seat 50 similar to other versions described above. The posts 60 are generally coaxially oriented so that they both act in unison against opposing seats when torque is applied. An advantage of the posts 60 embodiment may be that the posts 60 are easier to affix to the interior of the aperture 62, by means such as welding, as contrasted to a pin 26 as shown and described in FIG. 10.

Figure 10:
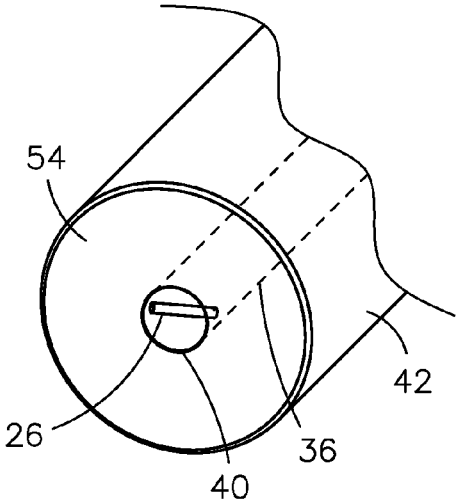
FIG. 10 is a partial perspective end view of a version of a roller.

FIGS. 9 and 10 show partial perspective views, respectively, of important versions of the device. In either the posts 60 configuration or the pin 26 configuration, the posts 60 and pin 26 may be inset into the bore 64 or bore 36, respectively. The depth to which the post 60 or pin 26 is inset can affect the overall length of the roller 56 or roller 14 because the roller can extend further away from the case 12 yet remain engaged into the seat 50.

In use for extracting juice from sugarcane stalks, a shaft diameter of about an inch and a half has been found to be effective. However, depending on the application a larger or smaller diameter shaft could also be effective. A range of about a quarter inch to about four inches could be used for varying applications. It would be readily apparent with minimal use whether the shaft size should be increased or decreased based on a visual inspection and the performance of the machine.

In the example above with an inch and a half shaft diameter, the gap of the slot 46 could be effective when about 0.393 inches plus or minus about a quarter of the diameter of the shaft. Obviously, depending on the application and diameter of the shaft the dimensions would be adjusted accordingly to be effective within the scope of this disclosure and common sense use.

The gap between the narrowest points of the seats 50 is in one embodiment slightly greater than the gap of the slot 46 as shown well in FIG. 6. Continuing the exemplary dimensions as in the paragraph above, the gap between the narrowest points of the seats 50 could effectively be about 0.530 inches. The pin 26 could be about 0.375 inches in diameter and the aperture 40 could have a diameter of about 1.5135 inches. Again, as the device is scaled up or down for different applications then these dimensions would also vary accordingly to remain effective.

In an effective variation of the device the pin 26 rests against the seats 50 when the pin 26 is at about fifteen degrees rotated from the direction of the slot 46. The degree difference between the pin 26 and slot 46 when the roller 14 is locked onto a shaft 24 can be from about five degrees to about fifty degrees and remain effective.

Again looking at FIG. 9, an advantage of the posts 60 over other versions of analogous elements is that less material is used, less work is required to make the shaft 24 and the end of the shaft 24 where the seats 50 are may withstand more torque. Also, both the roller 56 and the shaft 24 will be easier to clean. Less material is used because the amount of round bar required to make the posts 60 is less than that to make the pin 26, which has to span the whole diameter of the bore 36 of the roller 14. There is less cutting or machining work required to make the shaft 24. This is in part because although the slot 46, the pocket 48, and the seat 50 of a shaft 24 would engage with the posts 60 of a roller 56, it is not necessary to cut or machine a slot 46, a pocket 48, and a seat 50 that span the whole diameter of a shaft 24. In order for the posts 60 of a roller 56 to engage and have the torque from the shaft 24 transferred to the roller 56. Each of slots 46, pockets 48 and seats 50 of a shaft 24 would only need to be cut or machined on the same end at opposing walls of a shaft 24 in order to fit the posts 60 of a roller 56. Since less material would be cut from the end of the shaft 24 where the seats 50 would be, the shaft 24 may withstand more torque. The roller 56 and the shaft 24 will be easier to clean because there will be less surface area to get dirty. Furthermore, it is easier to clean behind the posts 60 than it is to clean behind the pin 26. Also, in order for each of slots 46, pockets 48 and seats 50 of a shaft 24 for a roller 56 to be easily cleaned, the exposed ends of the posts 60 of a roller 56 could be round so that the depths of each of the slots 46, the pockets 48 and the seats 50 of the shaft 24 could be made round to fit the round ends of the posts 60 of a roller 56, therefore there being no corners for dirtiness to get trapped into.

In yet another version of the device and to further increase the advantages of less material used, less work required to make the shaft 24, the end of the shaft 24 and the seats 50, in addition to allowing these elements to withstand more torque and be easier to clean, both the roller 56 and the shaft 24 can be constructed so that the roller 56 has only one post 60, the corresponding shaft 24 with only one slot 46, one pocket 48 and one seat 50.

In another version, the posts 60 have rounded exposed ends and the depths of the slots 46, the pockets 48 and the seats 50 is correspondingly round to complement each other for a good fit together.

In another version, the posts 60, pins 26 or other analogous elements can have a round, oval, rectangular, square or other polygonal cross section. The corresponding slots 46, pockets 48 and seats 50 could be effective with a complimentary geometry to ensure a good mating fit and are easy to clean yet can also disengage for roller removal or installation.

It should be noted that the terms pins, posts, pockets and seats have analogous elements in the several variations described herein that may be substituted for other similarly named parts in other versions. In other words a pin (or other named element) in one embodiment can be substituted for a version shown in another embodiment having a similar verbal definition.

An important version of the device can be fairly described as a roller press comprised of at least a first shaft 24 and a second shaft 30. The first and the second shaft each at a first end is rotatably affixed to a case 12 so that the shafts can rotate when powered during normal operation of the machine. The first shaft is parallel to the second shaft. Other shafts, if present, are also parallel. Each shaft is cylindrical with a first diameter that is the diameter of the body of the shaft. Each shaft has at a second end, away from the case, a rectangular slot 46 completely bisecting the second end of the shaft along the first diameter. Each slot has first dimension measured perpendicular to the first diameter that is essentially the gap of the slot at the end of the shaft. A pocket 48, inside the shaft at the slot end completely bisects each shaft 24 along the entire length of the first diameter of the second end of each shaft and is in spacial communication with the slot so that the pin 26 can enter the pocket 48 through the slot 46. The pocket at a midpoint along the first diameter has a second dimension that is narrower than a third dimension at a first circumferential edge and a fourth dimension at a second circumferential edge of the shaft. In other words the pocket is narrower at the middle of the shaft and wider around the edge of the shaft so that the pin 26 can rotate relative to the shaft and lock inside the pocket. The pocket at the second dimension is equal to or greater than the first dimension. The first diameter has a fifth dimension. A cylindrical roller having a first end and a second is provided for each shaft. Each roller has a cylindrical bore 36 completely through and coaxial to a centerline of the roller. The bore has a second diameter with a sixth dimension. The sixth dimension is greater than the fifth dimension so that the roller is adapted to coaxially fit over the shaft with the first end of the roller towards the case and the second of the roller towards the second end of the shaft. At the second end of the roller is a pin 26 along a second diameter of the bore. The pin has a third diameter with a seventh dimension that can pass through the slot 26 and enter into the pocket 48. The seventh dimension is less than the first dimension so that the pin 26 can pass through the slot 46 and enter the pocket 48. When the first diameter is parallel with the second diameter so that the pin can pass through the slot to enter or exit the pocket the sleeve is in an unlocked mode and the roller can be pulled off of or pushed onto the shaft. When pin is in the pocket and the first diameter is not parallel with the second diameter then the roller is in a locked mode that is biased in locked mode when the machine is on and torque is applied to the shafts and rollers.

An optional feature is found in that the pin spans the entire second diameter. Alternatively the pin can be on one side of the bore or can be attached to both sides of the bore with a gap between shorter posts in the middle as seen in FIG. 9. That pin has a centered gap of a predetermined eighth dimension, possibly about a third of the length of the pin. In another variation the pin spans only a portion of the second diameter. The pin can have any of a round, an oval or a polygonal cross section. It is preferred but not required that the seat 50 would match the cross section of the pin for a slop free fit.

Another varietal if the device can be fairly described as being a roller press comprised of a first shaft and a second shaft. This version is similar in some aspects to that shown in FIGS. 1, 6 and 9. The first and the second shaft each at a first end is rotatably affixed to a case. The first shaft is parallel to the second shaft. Each shaft is generally cylindrical with a first diameter. Each shaft has at a second end a slot at least partially bisecting the second end of the shaft along a portion of the first diameter. Each slot has first dimension measured perpendicular to the first diameter. A pocket partially bisects each shaft along the entire length of the slot at the second end of each shaft and is in spacial communication with the slot. The pocket at a predetermined point along the first diameter has a second dimension that is narrower than a third dimension at a first circumferential edge and a fourth dimension at a second circumferential edge of the shaft. The pocket at the second dimension is equal to or greater than the first dimension. The first diameter has a fifth dimension. A cylindrical roller having a first end and a second is provided for each shaft. Each roller has a cylindrical bore completely through and coaxial to a centerline of the roller. The bore has a second diameter with a sixth dimension. The sixth dimension is greater than the fifth dimension so that the roller is adapted to coaxially fit over the shaft with the first end of the roller towards the case and the second of the roller towards the second end of the shaft. At the second end of the roller is a pin along a second diameter of the bore. The pin has a third diameter with a seventh dimension. The seventh dimension is less than the first dimension so that the pin can pass through the slot and enter the pocket. When the first diameter is parallel with the second diameter so that the pin can pass through the slot to enter or exit the pocket the sleeve is in an unlocked mode. When pin is in the pocket and the first diameter is not parallel with the second diameter then the roller is in a locked mode. The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A roller press comprising a first shaft and a second shaft;
the first and the second shaft each at a first end is rotatably affixed to a case;
the first shaft is parallel to the second shaft;
each shaft is cylindrical with a first diameter;
each shaft has at a second end a rectangular slot completely bisecting the second end of the shaft along the first diameter;
each slot has first dimension measured perpendicular to the first diameter;
a pocket completely bisects each shaft along the entire length of the first diameter of the second end of each shaft and is in spacial communication with the slot;
the pocket at a midpoint along the first diameter has a second dimension that is narrower than a third dimension at a first circumferential edge and a fourth dimension at a second circumferential edge of the shaft;
the pocket at the second dimension is equal to or greater than the first dimension;
the first diameter has a fifth dimension;
a cylindrical roller having a first end and a second end is provided for each shaft;
each roller has a cylindrical bore completely through and coaxial to a centerline of the roller;
the bore has a second diameter with a sixth dimension;
the sixth dimension is greater than the fifth dimension so that the roller is adapted to coaxially fit over the shaft with the first end of the roller towards the case and the second end of the roller towards the second end of the shaft;
at the second end of the roller is a pin along a second diameter of the bore;
the pin has a third diameter with a seventh dimension;
the seventh dimension is less than the first dimension so that the pin can pass through the slot and enter the pocket;
when the first diameter is parallel with the second diameter so that the pin can pass through the slot to enter or exit the pocket then the roller is in an unlocked mode;
when pin is in the pocket and the first diameter is not parallel with the second diameter then the roller is in a locked mode.

2. The roller press as in claim 1, wherein the pin spans the entire second diameter.

3. The roller press as in claim 1, wherein the pin has a centered gap of a predetermined eighth dimension.

4. The roller press as in claim 1, wherein the pin spans only a portion of the second diameter.

5. The roller press as in claim 1, wherein the pin has any of a round, an oval or a polygonal cross section.

6. A roller press comprising a first shaft and a second shaft;

the first and the second shaft each at a first end is rotatably affixed to a case;

the first shaft is parallel to the second shaft;

each shaft is cylindrical with a first diameter;

each shaft has at a second end a slot at least partially bisecting the second end of the shaft along a portion of the first diameter;

each slot has first dimension measured perpendicular to the first diameter;

a pocket partially bisects each shaft along the entire length of the slot at the second end of each shaft and is in spacial communication with the slot;

the pocket at a predetermined point along the first diameter has a second dimension that is narrower than a third dimension at a first circumferential edge and a fourth dimension at a second circumferential edge of the shaft;

the pocket at the second dimension is equal to or greater than the first dimension;

the first diameter has a fifth dimension;

a cylindrical roller having a first end and a second end is provided for each shaft;

each roller has a cylindrical bore completely through and coaxial to a centerline of the roller;

the bore has a second diameter with a sixth dimension;

the sixth dimension is greater than the fifth dimension so that the roller is adapted to coaxially fit over the shaft with the first end of the roller towards the case and the second end of the roller towards the second end of the shaft;

at the second end of the roller is a pin along a second diameter of the bore;

the pin has a third diameter with a seventh dimension;

the seventh dimension is less than the first dimension so that the pin can pass through the slot and enter the pocket;

when the first diameter is parallel with the second diameter so that the pin can pass through the slot to enter or exit the pocket then the roller is in an unlocked mode;

when pin is in the pocket and the first diameter is not parallel with the second diameter then the roller is in a locked mode.

* * * * *